US006705492B2

(12) United States Patent
Lowry

(10) Patent No.: US 6,705,492 B2
(45) Date of Patent: Mar. 16, 2004

(54) BOTTOM-DISPENSING LIQUID SOAP DISPENSER

(75) Inventor: Adam Lowry, San Francisco, CA (US)

(73) Assignee: Method Products, Inc., San Francisco, CA (US)

( * ) Notice: Subject to any disclaimer, the term of this patent is extended or adjusted under 35 U.S.C. 154(b) by 0 days.

(21) Appl. No.: 10/185,603

(22) Filed: Jun. 27, 2002

(65) Prior Publication Data

US 2004/0000566 A1 Jan. 1, 2004

(51) Int. Cl.[7] ..... B65D 35/50

(52) U.S. Cl. ..... 222/184; 222/212; 222/215; 222/185.1; 222/210

(58) Field of Search ..... 222/105, 210, 222/212, 215, 184, 185.1, 494

(56) References Cited

U.S. PATENT DOCUMENTS

| | | | | | |
|---|---|---|---|---|---|
| 2,078,149 | A | | 4/1937 | Lutz | 221/60 |
| 2,125,784 | A | | 8/1938 | Higgins | 248/109 |
| 2,281,651 | A | | 5/1942 | Wolcott | 221/76 |
| 3,154,222 | A | * | 10/1964 | Heckman | 222/215 |
| 3,191,806 | A | | 6/1965 | Schultz et al. | 222/41 |
| 3,236,417 | A | | 2/1966 | Linton | 222/92 |
| D223,438 | S | * | 4/1972 | Lluch | D9/539 |
| 3,866,803 | A | | 2/1975 | Kipfmueller | 222/179.5 |
| 4,470,521 | A | | 9/1984 | Scammell et al. | 222/107 |
| 4,723,671 | A | | 2/1988 | Mears | 215/228 |
| 4,728,006 | A | | 3/1988 | Drobish et al. | 222/181 |
| 4,749,108 | A | | 6/1988 | Dornbusch et al. | 222/212 |
| 4,969,581 | A | | 11/1990 | Seifert et al. | 222/212 |
| 5,005,737 | A | | 4/1991 | Rohr | 222/212 |
| 5,033,655 | A | | 7/1991 | Brown | 222/212 |
| 5,065,966 | A | | 11/1991 | Hartke | 248/146 |
| 5,115,950 | A | | 5/1992 | Rohr | 222/490 |
| 5,118,012 | A | | 6/1992 | Miller et al. | 222/105 |
| 5,213,236 | A | | 5/1993 | Brown et al. | 222/185 |
| 5,271,531 | A | | 12/1993 | Rohr et al. | 222/212 |
| 5,292,035 | A | * | 3/1994 | Millar | 222/184 |
| 5,307,955 | A | | 5/1994 | Viegas | 222/107 |
| 5,339,995 | A | | 8/1994 | Brown et al. | 222/185 |
| 5,390,805 | A | | 2/1995 | Bilani et al. | 215/260 |
| 5,409,144 | A | | 4/1995 | Brown | 222/185 |
| D363,225 | S | * | 10/1995 | Kudo | D9/520 |
| 5,460,298 | A | * | 10/1995 | DiBiase et al. | 222/184 |
| 5,626,262 | A | * | 5/1997 | Fitten et al. | 222/184 |
| 5,655,687 | A | * | 8/1997 | Fitten et al. | 222/212 |
| 5,667,107 | A | | 9/1997 | Lindsey | 222/173 |
| 5,868,288 | A | * | 2/1999 | Redmond et al. | 222/212 |
| 5,918,777 | A | | 7/1999 | Flak | 222/212 |
| 6,095,382 | A | * | 8/2000 | Gross | 222/494 |
| 6,230,940 | B1 | | 5/2001 | Manning et al. | 222/185.1 |

FOREIGN PATENT DOCUMENTS

| | | |
|---|---|---|
| GB | 2 098 958 a | 3/1981 |

* cited by examiner

*Primary Examiner*—Kenneth Bomberg
(74) *Attorney, Agent, or Firm*—Coudert Brothers LLP

(57) ABSTRACT

A dispenser for liquids, such as dish soaps. The dispenser includes a bottom-dispensing squeeze container with flow controlled by a pressure actuated, self-closing valve, and a base integrated into the container. The container is ergonomically shaped to provide a handgrip to allow gripping with either hand from any direction and to provide a natural location to grip and squeeze the container. The base threads onto the stand to support the container on a surface while preventing other elements, such as the valve, from contacting the surface and allowing for a liquid to be dispensed through the stand. An alternative embodiment is also provided that includes a sealing mechanism for transport of the dispenser.

15 Claims, 6 Drawing Sheets

BOTTOM-DISPENSING LIQUID SOAP DISPENSER

FIELD OF THE INVENTION

The present invention is directed to a bottom-dispensing container for liquids. Specifically, the invention is directed to an ergonomically designed container that allows the user to grasp and squeeze the container to discharge soap.

BACKGROUND OF THE INVENTION

Containers for small quantities of household liquids, such as soap, hair products, food stuffs, or the like, are usually configured to dispense either by actuating a pump, by inverting and squeezing the container, or by tipping the container to pour the contents. Container configurations are determined primarily by the need to both store and dispense liquids, resulting in a preferred container orientation for both storage and dispensing, and additionally by the ability, ease and responsiveness with which the user can dispense useful quantities of the liquid of interest, the ergonomics of the container, the aesthetic design, and the container cost. Some of the available container configurations include rigid containers for pouring or pump dispensing, squeeze containers having a bottom for resting the container and an opening for dispensing liquid from either the top or bottom of the container, and collapsible containers.

Bottom-dispensing containers typically rest on a surface or are suspended. These containers include an opening on the bottom for dispensing the liquid and actuation means for dispensing the liquid. Squeeze containers are usually formed from a resiliently deformable material and have an opening that may have a valve to control the flow through the opening. One type of valve is an on-off valve that is actuated by rotating the valve. Another particularly useful valve is a pressure-responsive dispensing valve that controls the flow according to a pressure difference across the valve. Such a valve can be configured to be normally closed and to assume an open configuration when the container is squeezed. Optional features of bottom dispensing squeeze containers include a cap to prevent loss of the liquid between dispensing. Bottom-dispensing containers of rigid materials having pump mechanisms are also in the prior art.

Bottom-dispensing containers have several advantages over other packaging configurations. The container does not need to be inverted, requiring fewer user motions for dispensing and providing greater positioning and dispensing control than for containers that dispense by pouring or inverting and squeezing. Thus for example, the user does not have to rotate his wrist and wait for a viscous liquid to travel to the opening, or have trouble controlling the flow rate when the container is full as in the use of containers adapted to pour from the top. Bottom-dispensing containers can also be configured to allow nearly all of the liquid to be dispensed—something usually not possible with containers having a pump on the top. Bottom-dispensing containers having pressure-responsive valves also have the advantage of not requiring a separate closure mechanism.

As a result of the configuration of bottom-dispensing containers, there are several practical problems that must be overcome to enable manufacturing of bottom-dispensing squeeze containers that are easy to use, ergonomic and aesthetically pleasing. The problems include ventilation of the chamber after dispensing liquid, loss of liquid by leaking through the valve, the integration of a stand into the container, and an ergonomic design that allows the user to easily and efficiently dispense liquid.

Solutions to the ventilation problem include having a collapsible container, or having a rigid or flexibly deformable container that has either a one-way valve separate from a dispensing valve to allow for air to enter the container or a two-way dispensing valve that allows both for flow of liquid out of the container and air back into the container. Collapsible containers change shape as a result of dispensing liquid and are best used with highly viscous materials, such as toothpaste. For liquids such as soaps, rigid or flexibly deformable containers are preferred. In addition, a single piece two-way dispensing valve, such as the valve described in U.S. Pat. No. 5,213,236 to Brown, et al. ("the '236 patent"), allows for both dispensing and ventilation of the container.

Leakage from bottom-dispensing containers in a resting orientation results from the liquid being over and in contact with the opening. Leakage can even occur from packages having a dispensing valve from the contact of the valve or opening with a resting surface, causing "wicking" of liquid through the valve. A general requirement is that containers should be able to stay in a closed configuration, regardless of the amount of liquid in the container or environmental changes, such as barometric pressure and temperature. One prior art solution to limiting leakage includes providing a lid that is removed prior to dispensing. Such a lid can either be part of a container stand from which the container is removed prior to dispensing, or can be provided as part of the container to be removed for dispensing, either in the upright orientation, or by momentarily moving the container to another orientation to remove the lid. The use of a two-way valve provides another solution to the leakage problem. The two-way valve described in the '236 patent prevents leakage over a range of temperatures, and thus is well suited for use in a household environment. Since the valve does not leak as long as it does not contact a support surface, it is also well suited for bottom-dispensing squeeze containers that do not require the use of a removable cap, top or lid.

Prior art bottom-dispensing, squeeze containers are difficult to use, particularly when large quantities of liquids are contained. These problems result primarily from the shape of the container, the location at which a user is likely to grab the container, and the distribution of weight of the container. For example, the use of containers with straight walls, such as in the '236 patent, or U.S. Pat. No. 4,728,006 to Drobish, et al., U.S. Pat. No. 4,749,108 to Dornsbusch, et al., or U.S. Pat. No. 5,667,107 to Lindsey ("the '107 patent"), or with slightly bulging walls, as in U.S. Pat. No. 5,033,655 to Brown, present problems when the containers have a large amount of liquid and thus are heavy, especially when the users hands are wet or slippery. The user can grip the container at any position along the container, and it tends to slip through the user's hands, since there is no natural handgrip location larger to prevent downward slippage of the heavy container.

Containers that are larger at the top, usually resulting from the use of a stand with a prior art invertible container, as in the '107 patent, can be top heavy when the containers are full. These containers thus may be unstable when on a resting surface, and the greater weight above the user's hand may make it difficult to maneuver or position the container for dispensing. In summary, prior art bottom-dispensing, squeeze-type containers are not ergonomic in that they do not indicate by their design a proper location to grab and squeeze the container for ease of use.

Lastly, cost considerations usually require that the bulk of the container be blow molded. This places certain restrictions on the container shape. In particular, to prevent leakage, bottom-dispensing containers require that the dispensing valve not contact the support surface. Blow molded containers, however, cannot be formed having the required support structure, and thus include a separate base portion. Some prior art bottom-dispensing containers provide bases that are formed along with the container, a configuration that is not compatible with blow molding. Other prior art containers include separate bases that are tapered, having a wide lower portion, or a constant cross-sectional extension of the bottom portion of the container. These containers are not ergonomic in that they do not indicate to the user the correct location to grab and squeeze or have a shape that prevents slippage of the container when in use. In addition, these containers are not aesthetically pleasing.

What is required is a bottom-dispensing squeeze container that is ergonomically designed. Such a container should be capable of holding fairly large quantities of liquid while being stable at rest on a surface, to allow for access to the container from any direction and with either hand, to have a shape that prevents slippage of the container from the hand, and to have a base that it an integral part of the ergonomic container design.

BRIEF SUMMARY OF THE INVENTION

The present invention provides a dispenser for dispensing liquids from the bottom of a container that addresses the problems of prior art bottom-dispensing, squeeze containers. In accordance with the present invention, a dispenser for the bottom-dispensing of a liquid in a squeeze container is provided that overcomes the above-identified problems through the ergonomic design of a container and an integrated base.

It is thus one advantage of the present invention to provide a bottom-dispensing apparatus that is capable of containing fairly large quantities of liquid as would be used in a household environment, while being stable at rest on a surface.

It is yet another advantage of the present invention to provide an ergonomically designed bottom-dispensing container having a waist between two larger ends, providing a natural position to grab the container and allowing for the weight of the liquid to be evenly distributed above and below the hand.

It is another advantage of the present invention to provide a bottom-dispensing apparatus having a container that is accessible from any direction and with either hand, and that has a shape that prevents slippage from the hand.

It is yet another advantage of the present invention to provide a bottom-dispensing apparatus that ergonomically designed and that integrates a base with a container to provide the user with an indication of the functioning of the apparatus.

It is a further advantage of the present invention to provide a bottom-dispensing apparatus that has a container with a narrow waist for grabbing between the thumb and index finger, a large surface area for squeezing between the fingers and the palm of the hand, and an enlarged bulbous portion above the waist to prevent the container from slipping out of the user's hand. It is another aspect to provide a base for the apparatus to provide an indication of the ergonomic design of the container.

It is yet a further advantage of the present invention to provide a container and base for a bottom-dispensing apparatus that are economical to manufacture.

It is a key aspect of the present invention to provide a liquid dispensing apparatus comprising a hollow, elongated container for the liquid and a frusto-conical base. The elongated container has a bulbous upper portion and a frusto-conical lower portion with a bottom wall at the larger diameter thereof. The bottom wall has an opening therein for discharging liquid from the container. The frusto-conical lower portion is deformable and ergonomically proportioned to permit gripping and compression by a human hand to cause ejection of liquid through the opening. The bulbous upper portion is sized to prevent downward slippage of the frusto-conical lower portion when gripped. The frusto-conical base is secured to the lower portion and forms a continuation of the frusto-conical shape of the lower portion. The base has a lower rim lying in a plane transverse to the elongated container for supporting it in an upright condition when the base is positioned on a substantially planar surface.

It is another key aspect of the present invention to provide a liquid dispensing apparatus comprising a hollow, elongated container for the liquid. The container has a deformable handgrip formed a frusto-conical lower portion with a bottom wall at the larger diameter thereof, and a waist at the upper end of the lower portion. The bottom wall has an opening therein for discharging liquid from the container. The frusto-conical lower portion and waist are ergonomically proportioned to permit gripping and compression by a human hand to cause ejection of liquid through said opening. The apparatus also includes a frusto-conical base secured to the lower portion to form a continuation of the frusto-conical shape of the lower portion. The base has a lower rim lying in a plane transverse to the elongated container for supporting it in an upright condition when the base is positioned on a substantially planar surface.

Additional objects, advantages, aspects and features of the present invention will become apparent from the description of preferred embodiments, set forth below, which should be taken in conjunction with the accompanying drawings, a brief description of which follows.

BRIEF DESCRIPTION OF THE SEVERAL VIEWS OF THE DRAWING

FIGS. 5–7 are a sequence of side views showing the use of the apparatus of FIG. 1, wherein FIG. 5 shows the container having being grabbed and moved upwards from a horizontal surface; FIG. 6 shows the user squeezing the container to dispense liquid; and FIG. 7 shows the user relaxing her grip to cease dispensing liquid.

Reference symbols are used in the Figures to indicate certain components, aspects or features shown therein, with reference symbols common to more than one Figure indicating like components, aspects or features shown therein.

DETAILED DESCRIPTION OF THE INVENTION

The dispenser of the present invention is an apparatus formed from a bottom-dispensing, squeeze bottle container supported by a base adapted for resting on a surface, and that is adapted for lifting from the surface by grabbing an ergonomic handgrip formed by the outer surface of the container. The dispenser releases a liquid from the container through a valve on the container bottom by squeezing the gripped container. The base is intended to rest on a surface that may be substantially flat and is preferably horizontal. Directional indications "bottom," "top," "up," "down," "above," and "below" as used herein generally refer to directions relative to that part of the apparatus or dispenser that is intended to rest on the support surface. Directional indications "inner," "inside," "outer," and "outside" as used herein generally refer to directions towards or way from the center or interior of the dispenser. In addition, while the container is configured to dispense from the bottom of the container, the orientation of the container does not have to be perpendicular to the horizon.

The present invention will be described in terms of a bottom-dispensing apparatus that may be used to hold and dispense a liquid that might be used in a household, such as dish soap. The dispenser may be used for other liquids, such as other types of soaps or skin or hair care products, or foodstuffs, such as ketchup or mustard. The present invention provides an ergonomically designed dispenser that is useful for dispensing liquids in public or industrial settings as well as in a household. These descriptions are meant to be illustrative and not to limit in any way the scope of the invention as claimed.

Figure 1:
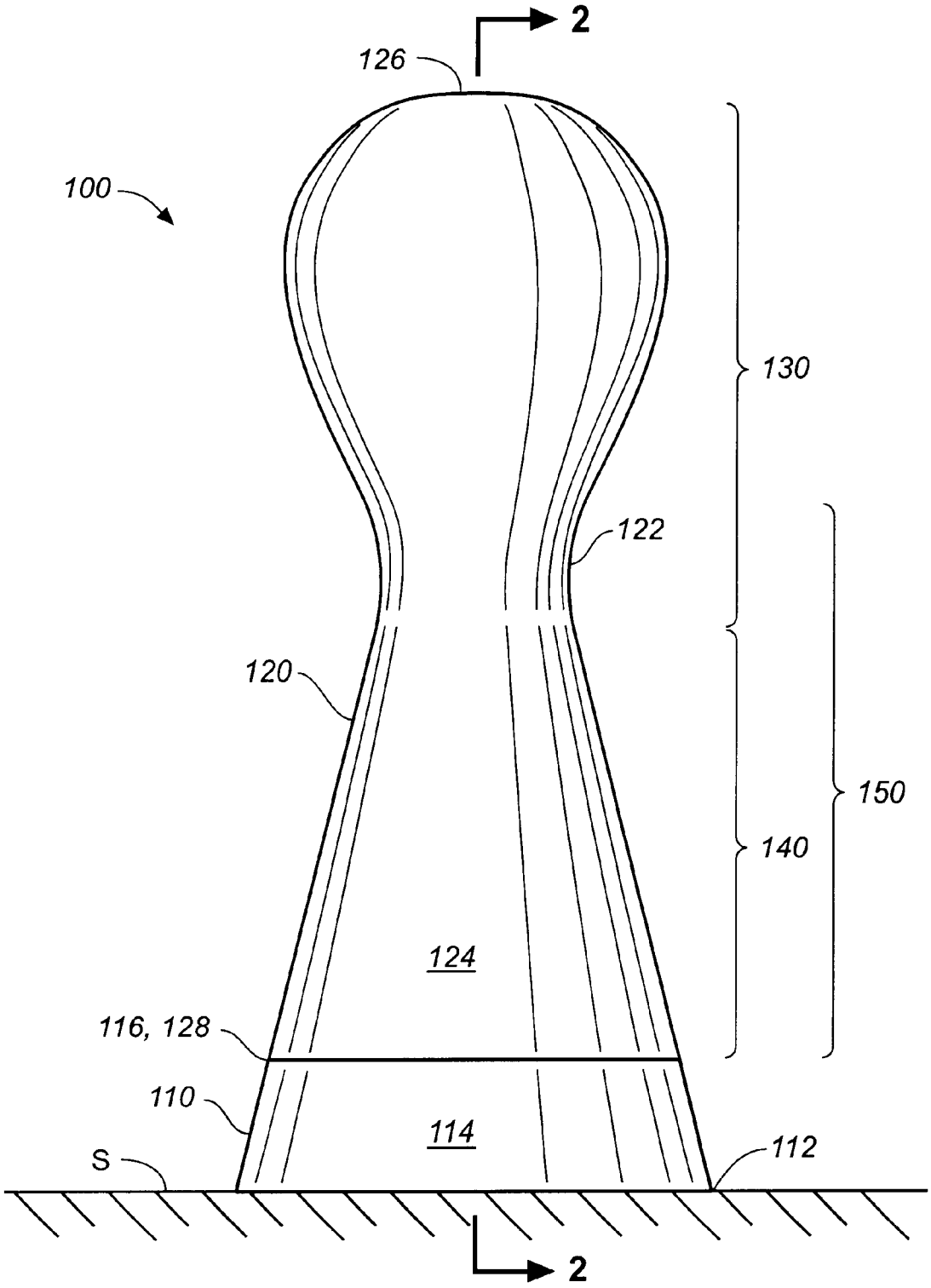
FIG. 1 is a side view of an embodiment of a bottom-dispensing apparatus of present invention.

An embodiment of the present invention is presented in the several views of FIGS. 1–4. FIG. 1 is a side view of a bottom-dispensing apparatus or dispenser 100 of present invention includes a container 120 and a base 110 for supporting the dispenser, as on a surface S. Container 120 has an outer surface 124 that extends longitudinally from a top 126, to a waist 122, to a bottom edge 128. Base 110 has an outer surface 114 that includes a top edge 116 that is adjacent to bottom edge 128, and extends longitudinally to a rim 112. Rim 112 is adapted for resting base 110 on a surface S, while the base supports container 120. It is preferred that surfaces 114 and 124 form a surface of rotation about the longitudinal axis that extends from top 126 through the centroid of rim 112. In a particularly preferred embodiment, surface 124 includes a bulbous upper portion 130 that includes waist 122 and has a smooth transition to a lower portion 140 that has a frusto-conical shape terminating in a circular bottom edge 128. It is also a feature of the particularly preferred embodiment that surface 114 continue the frusto-conical shape from circular top edge 116 to circular rim 112.

Container 120 and base 110 are adapted to function together to provide an ergonomic shape that naturally indicates to the user the proper location to grab and squeeze the container. Specifically, a handgrip 150 is formed by waist 122 and lower portion 140, where the waist provides for placement of the thumb and forefinger of either hand and lower portion provides for placement of the fingers for holding dispenser 100 and squeezing the lower portion. For ease of use, it is preferred that handgrip 150 is configured with waist 122 having a diameter to allow the human hand to grab the waist between the thumb and forefinger and lift dispenser 100. The diameter of waist 122 should thus be between 1 and 2 times the diameter of a circle formed by the thumb and forefinger of the average size hand of the intended user. It is also preferred that the height of handgrip 150, from waist 122 to bottom edge 128, be larger than the width of the average sized hand of the intended user. Handgrip 150 is approachable by either hand from any direction, and allows for naturally positioning fingers of either hand over squeezable lower portion 140, as described subsequently. In addition, surface 114 of base 110 is a continuation of surface 124 of container 120. This provides clean lines to the user indicating that waist 112 is the position for grabbing the dispenser.

Figure 2:
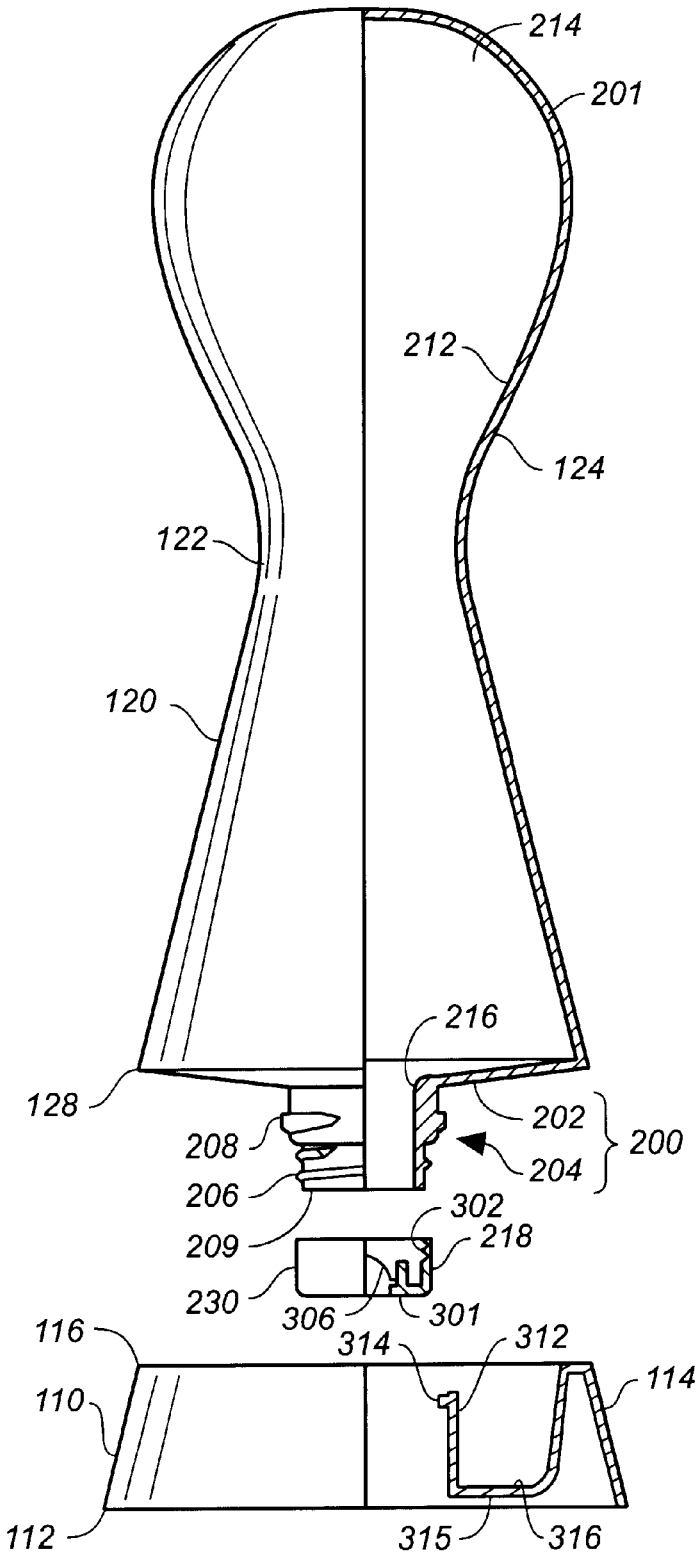
FIG. 2 is a composite exploded assembly and sectional view of the side of the embodiment of FIG. 1.
Figure 3:
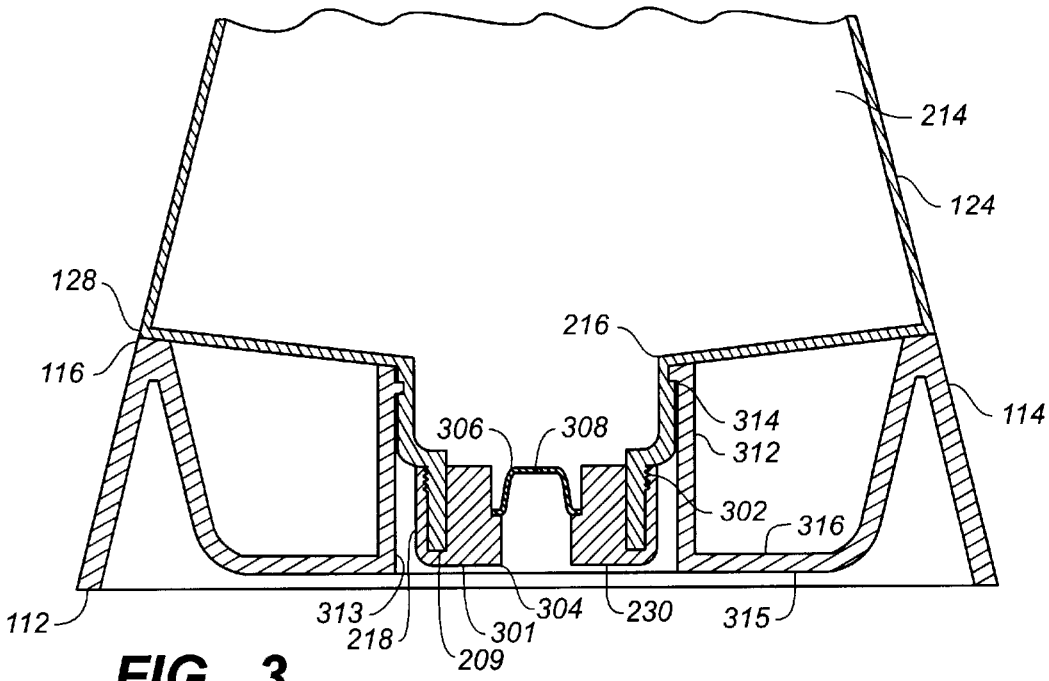
FIG. 3 is a sectional side view of the base, valve with cap, and a portion of the container of the embodiment of FIG. 1.
Figure 4:
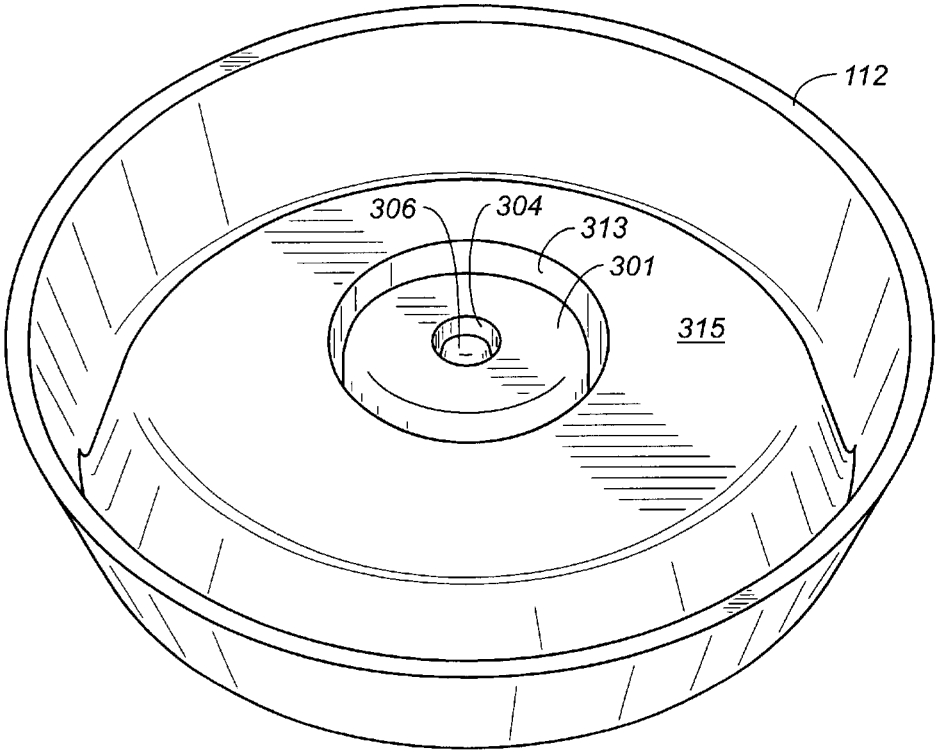
FIG. 4 is a perspective bottom view of the base of the embodiment of FIG. 1.

Dispenser 100 is shown in greater detail in FIG. 2, which is a composite exploded assembly and sectional view, and FIG. 3, which is a sectional side view of the base, valve with cap, and a portion of the container. Container 120 is a hollow, elongate vessel having a wall 201 formed of a resiliently deformable material. Wall 201 has an inner surface 212 that bounds a container volume 214. The thickness and material of wall 201 are tailored along the outer surface 124 portion of container 120 to provide a container that maintains a specified shape when the container is empty or full of a liquid, and that has a specified area corresponding with lower portion 140 that is deformable by squeezing by the hand of a user. Specifically, the thickness and material of wall 201 along lower portion 140 are selected so that the fingers of a hand so grabbing the dispenser can easily apply sufficient pressure to decrease the volume of container 214, allowing for squeeze dispensing of a liquid contained therein. In one embodiment, the thickness of wall 201 along lower portion 140 is approximately of constant thickness, providing a large surface for squeezing.

FIG. 2 also shows that container 120 includes a bottom portion 200 hidden from view in the assembled dispenser shown in FIG. 1. Specifically, bottom portion 200, which is formed from wall 201, forms a container bottom 202 that protrudes inwards and downwards from bottom edge 128 to a rim 216, and a neck 204 that extends longitudinally downwards from rim 216 to an opening 209. Bottom portion 200 also includes a first set of external threads 206 and a second set of external threads 208, whose functions are described subsequently.

FIGS. 2 and 3 also show that cap 230 has an outer surface 218, a dispensing valve 306, a set internal threads 302, and a bottom 301 having an orifice 304. Threads 302 are adapted to be threadably attached to neck 204 at threads 206. Cap 230 so attached provides a valve having an open and closed configuration for holding a liquid contained within container volume 204 of dispenser 100, and dispensing the liquid through orifice 304, respectively. Valve 306 is preferably a two-way valve that remains closed over some range of pressure differences and that opens in either direction according to the amplitude of the pressure difference. In one embodiment, valve 306 is a resiliently flexible member having a slit 308 that is normally closed and that opens when deformed more than a set amount upwards or downwards. When the pressure level above the valve is lower than a predetermined and engineered level, the valve is closed. When the pressure rises above the predetermined level, the valve opens, allowing liquid to flow from high to low pressure. Alternatively, if the pressure above the valve drops below a predetermined value that is below atmospheric pressure, the valve opens allowing air into the container. The valve of the '236 patent, incorporated herein by reference, is one such valve, though other mechanisms may perform equivalent functions as that valve.

Base 110 includes a member 316 that protrudes inwards and downwards from outer surface 114 at top edge 116 to a hollow inner cylindrical member 312 that forms a longitudinal opening 313. Cylindrical member 312 has a set of internal threads 314 adapted to be threadably attached to neck 204 at threads 208. The outer diameter of cap outer surface 218 is less than the outer diameter of threads 208, allowing for longitudinal access of base 110 for threading onto threads 208. Base 110 and container 120 so attached provides support of the container at threads 208 by inner cylindrical member 312 and at bottom edge 128 at top edge 116. In addition, member 316 defines a lower surface 315 that is longitudinally displaced from rim 112. The assembled cap bottom 301 is also longitudinally displaced from rim 112, such that only rim 112 of dispenser 100 contacts a planar support surface, such as surface S.

When assembled, dispenser 100 thus can rest on surface S contacting only rim 112, while container 120 is threadably attached to both base 110 and cap 130. Cap 130 includes valve 306 that provides control of fluid flow through opening 209 according to the pressure difference across the valve. In addition, base 110 has a longitudinal opening 313 for providing a longitudinal path for liquid dispensed from container 120 to flow downward.

The assembly of dispenser 100 from several components, and in particular having base 110 separate from container 120 has several advantages. Since the container and base have different functions, it is advantageous to form them of different materials. This results in the ability to tailor the material, thickness, surface finish and shape of the portions separately. The container is an elongated hollow structure for storing a liquid, while the base supports the weight of the container while providing that the container and valve do not touch a support surface. The container and base function together in supporting the container over a surface and in providing an ergonomic and intuitive shape for the user.

Container 120 is a squeeze container, and thus the thickness of the container walls must be controlled to provide acceptable performance for dispensing liquid. Acceptable container materials include, but are not limited to, plastics or elastomers. The preferred technique for forming the container is the widely used process of blow molding. This technique allows for the manufacture of hollow structures with accurate control of wall thickness and the ability to include some features for fastening, such as threads. Blow molding is cost effective, and provides for the production of containers having a wide range of resiliency, density, opacity, surface finish or color. By varying the mold shape and process characteristics, the container can include rigid portions of thick material, squeezable portions of thin material, external threads for attachment to other components. In addition, advantageous surface textures can be achieved by sandblasting the inside of mold to produce a surface that is opaque and that provides a non-slip surface to the user. Blow molding does not easily provide the ability to generate complex shapes, such as complex features that bend back on themselves, since the final product must be removed from a mold. Alternative methods for forming the container include, but are not limited to, forming the container from two injection molded halves.

Base 110 must be rigid enough to support the container on a support surface without excess weight and have an opening that allows for liquid to flow therethrough. Acceptable base materials include, but are not limited to, plastics or elastomers. Since it would be difficult to blow mold the container along with the base due to the complex shape, the base is more appropriately manufactured using different techniques. A preferred technique for forming the base is by injection molding. Alternatively, the base could be formed by machining plastics or metals.

Container 120 and base 110 are adapted to function together to provide an ergonomic shape that naturally indicates to the user the proper location to grab and squeeze the container. The ergonomic functioning of handgrip 150 and the continuous lines of the outer surfaces of container 120 and base 110 have been described previously. As noted, these provide a combined shape that is ergonomic, indicative of the correct location to grab, and is pleasing to the eye. In summary, the shapes of container 120 and base 110 according to the present invention are manufactured and assembled in ergonomic configurations that are not present in the prior art.

The operation of the present invention will now be described with reference to the operation of the embodiment of FIG. 1. The following discussion is meant for illustrative purposes and not as a limitation of the scope of the present invention.

Dispenser 100 can be filled with a liquid in preparation for dispensing as follows. Container 120 of an unassembled dispenser 100 is first inverted with opening 209 upwards. Container 120 is then filled with liquid. Cap 230 is threaded onto threads 206, and base 110 is then threaded onto base 208. Dispenser 100 is then inverted to the preferred orientation, with rim 112 downward. Valve 306 is selected so that the weight of any liquid held in container 120 is insufficient to open the valve, which remains in a closed configuration in the absence of any additional internal pressure in the container. The container is thus situated upright with the valve closed, and is ready for dispensing liquid.

Figure 8:
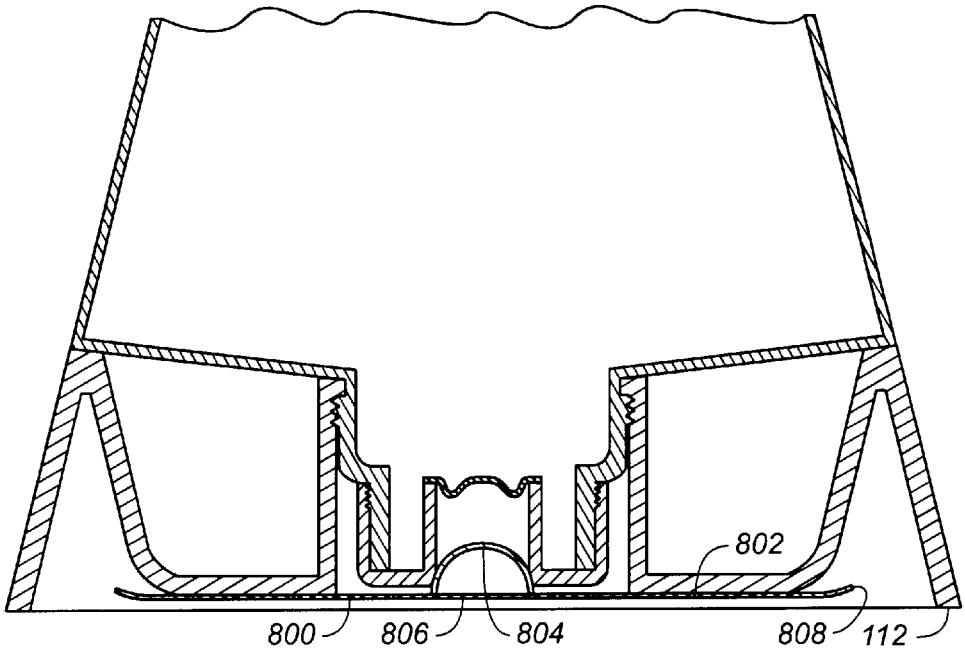
FIG. 8 is a sectional side view of an alternative embodiment of the present invention showing the valve sealed prior to use.
Figure 9:
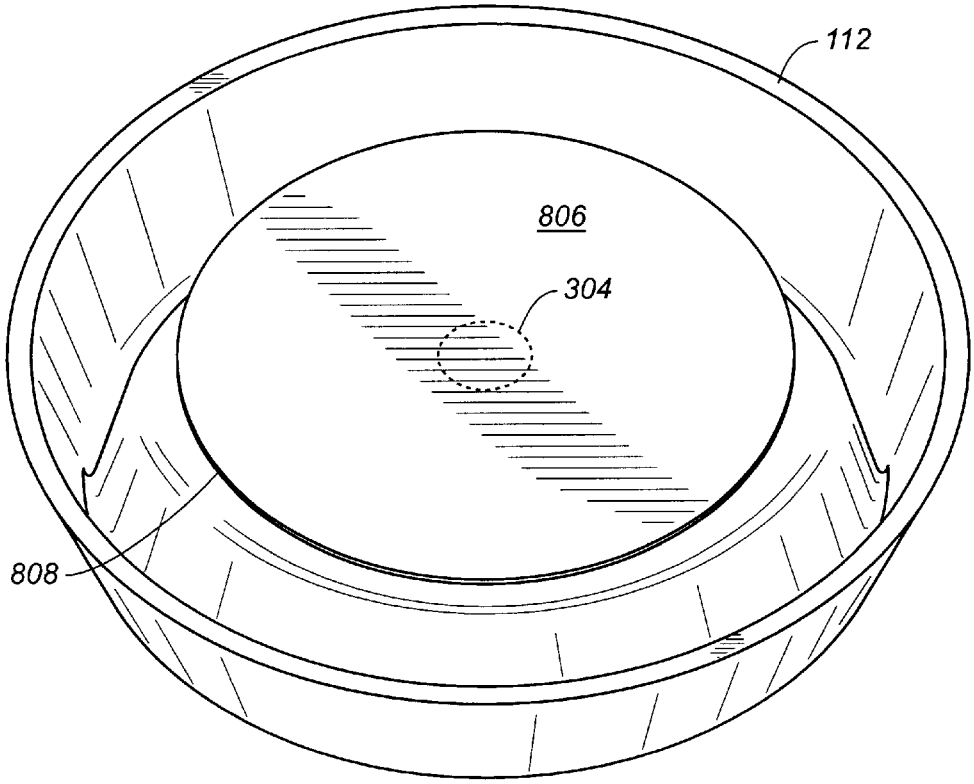
FIG. 9 is a perspective bottom view of the embodiment of FIG. 8 showing the valve sealed prior to use.

An alternative embodiment for filling and storing liquid for preparation for dispensing is shown in FIGS. 8 and 9 to provide a hermetic seal for shipping of an dispenser of the present invention, and to mechanically prevent the valve from opening. Specifically, FIG. 8 is a sectional side view of showing the valve sealed prior to use, and FIG. 9 is a perspective bottom view of the embodiment of FIG. 8 showing the valve sealed prior to use. In the alternative embodiment, container 120 is filled as previously described. A seal 800 is applied in preparation for shipping. Seal 800 has a bottom facing surface 806, a surface opposite the bottom facing surface having an adhesive layer 802, an outer edge 808, and a bubble 804. Bubble 804 is dimensioned to fit within orifice 304 and to protrude far enough towards valve 308 to prevent the valve from opening as a result of downward displacement. Adhesive layer 802 covers a sufficient amount of area to adhere seal 800 to bottom 301 and lower surface 315, providing a hermetic seal for container 120 and to keep bubble 804 from being displaced downward and thus allowing valve 306 to open. The dispenser of the alternative embodiment of the present invention can then be shipped without concern of leakage of the liquid from the container. Prior to use, seal 800 of a dispenser according to the alternative embodiment is removed by grasping and pulling outer edge 808, and the dispenser is then inverted with rim 112 in a downward orientation. The container is thus situated upright with the valve closed, and is ready for dispensing liquid. Alternative embodiments include, but are not limited to, surface 806 being used to supply printed information to a user or a barcode for identification, and outer edge 808 forming a protrusion in the shape of a tab for pulling.

Figure 6:
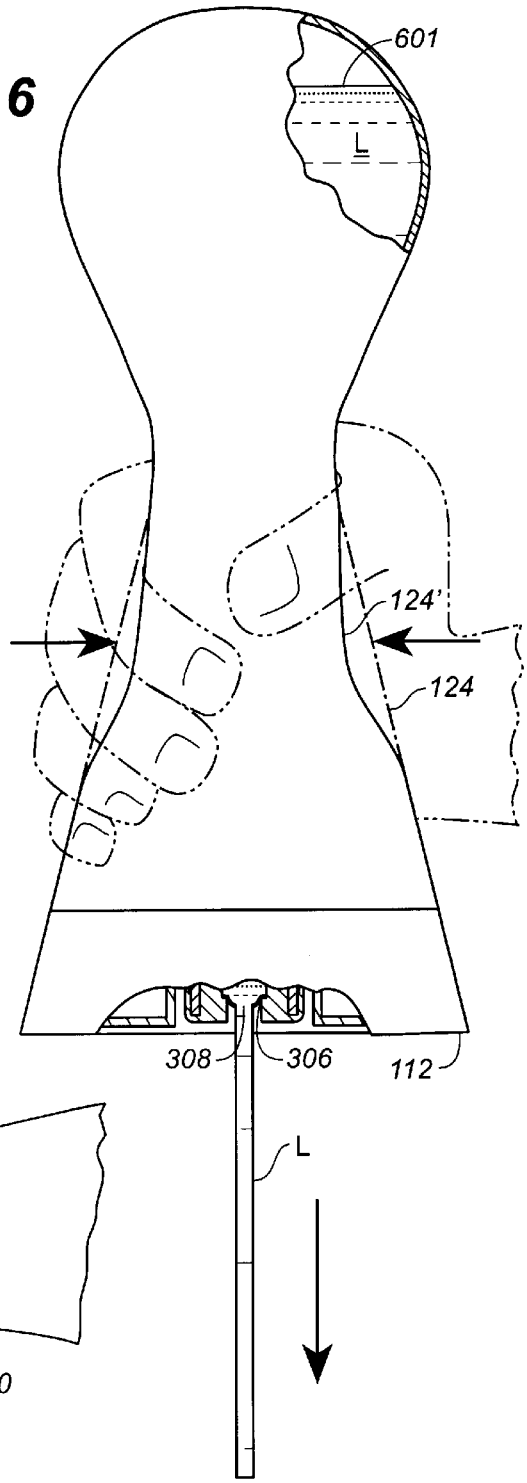
Figure 5:
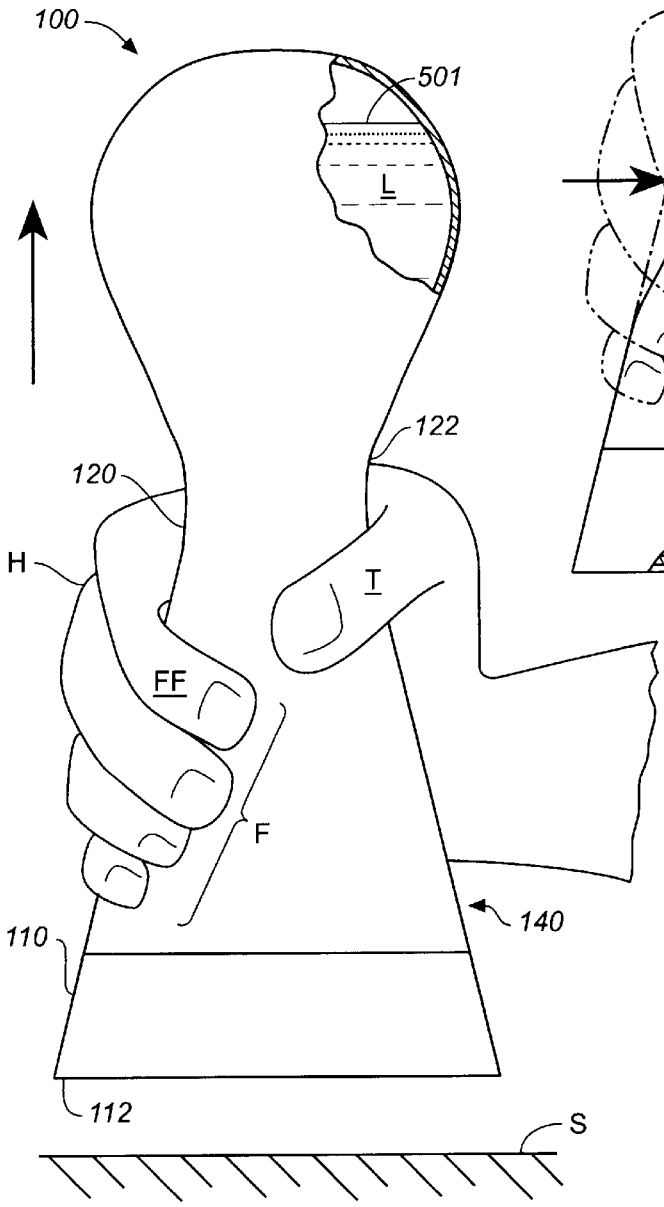
Figure 7:
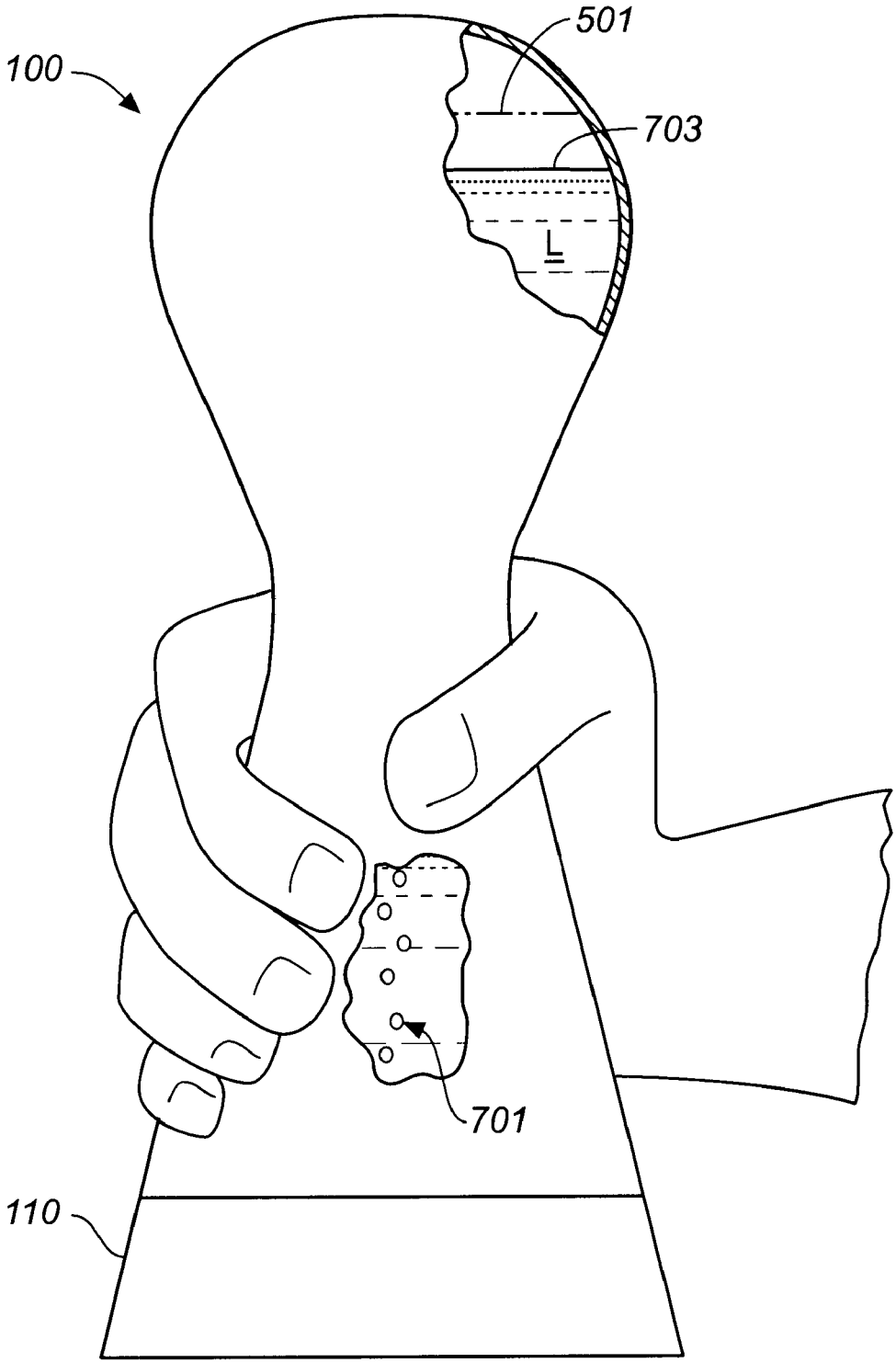

As noted, the squeeze bottle dispenser of the present invention includes a container formed of a resiliently deformable material. In use, the dispenser is intended to be grasped by a human hand in natural and ergonomic configuration that allows for easy holding between the thumb and forefinger and natural placement of the fingers over a portion of the dispenser that requires only slight compression to dispense a liquid contained therein. These features are illustrated in FIGS. 5–7, which show a sequence of side views showing the use of the dispenser of FIG. 1. Specifically, FIG. 5 shows the container having being grabbed and moved upwards from a horizontal surface, FIG. 6 shows the user squeezing the container to dispense liquid, and FIG. 7 shows the user relaxing her grip to cease dispensing liquid.

Referring first to FIG. 5 showing the grasping and lifting of dispenser 100 at handgrip 150, human hand H is shown with thumb T and forefinger FF encircling waist 122. Also shown in FIG. 5 is a level 501 of liquid L. In addition, fingers F are placed over lower portion 140 of container 120. As noted previously, the thickness and material of wall 201 along lower portion 140 is selected so that the fingers of a hand so grabbing the dispenser can easily apply sufficient pressure to decrease volume 214. When valve 306 is in a closed configuration, the decrease in volume 214 will increase the pressure in the volume, thus actuating valve 306 to dispense liquid.

It is noted that the high liquid level of FIG. 5 is shown as an example and is not needed to easily dispense liquid—the present invention dispenses liquid easily at nearly any level. As is most clearly seen in FIG. 3, by shaping the downward sloping container bottom portion 200 and minimizing the volume of container 120 near valve 306, the container can dispense nearly all of the contents of the container.

With dispenser 100 grasped as in FIGS. 5–7, the weight of the dispenser is naturally supported by the thumb and forefinger, as the upper portion 130 is larger than waist 112, where the dispenser is being grasped. In addition, the rotationally symmetric shape and continuous flow of lines from wide rim 112 to narrow waist 122 both indicate to the user that this is the position to grasp dispenser 100, and allows for grasping by either hand from any direction. Thus, fingers F from either hand will be positioned over the portion of dispenser 100 intended for squeezing.

The next step in dispensing liquid is illustrated in FIG. 6. After positioning the center of rim 112 over a target for liquid L, an inward force is applied by fingers F and hand H as indicated by the inward facing arrows. The degree of movement of outer surface 124 to an outer surface 124' is exaggerated for ease of illustration. Initially upon squeezing, valve 306 is closed and the application of force results in an increase in pressure within the container. As illustrated in FIG. 6, after a threshold pressure is reached, determined by the material, shape and size of slit 308, the slit opens, allowing liquid to pass, and a stream of liquid L is dispensed as shown by the downward pointing arrow of FIG. 6. The liquid L maintains a level 601 that is approximately the same as level 501 during dispensing.

When the grip is relaxed, as in FIG. 7, valve 306 momentarily allows back flow, causing air bubbles 701 to rise in liquid L and thus lowering the liquid to a level 703 that is lower than the initial level 501. Alternatively, the flow of liquid will cease when the pressure in the squeezed container drops as a result of the decreased liquid volume in the container. In either case, dispenser 100 can be returned to surface S.

The invention has now been explained with regard to specific, embodiments. Variations on these embodiments and other embodiments may be apparent to those of skill in the art. It is therefore intended that the invention not be limited by the discussion of specific embodiments. It is understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A liquid dispenser comprising:

a hollow, elongated container for the liquid, said container having a bulbous upper portion and a frusto-conical lower portion with a bottom wall at the larger diameter thereof, said bottom wall having an opening therein for discharging liquid from said container, said frusto-conical lower portion being deformable and ergonomically proportioned to permit gripping and compression by a human hand to cause ejection of liquid through said opening, said bulbous upper portion being of a size to prevent downward slippage of said frusto-conical lower portion when gripped; and a frusto-conical base secured to said lower portion and forming a continuation of the frusto-conical shape of said lower portion, said base having a lower rim lying in a plane transverse to said elongated container for supporting same in an upright condition when said base is positioned on a substantially planar surface.

2. The dispenser of claim 1, further comprising a dispensing valve at said opening, where said valve has a normally closed configuration and an open configuration actuated by said compression.

3. The dispenser of claim 1, wherein said liquid is a soap.

4. The dispenser of claim 3, wherein said soap is a dish soap.

5. The dispenser of claim 1, wherein said frusto-conical base has a longitudinal passage therethrough adjacent to said opening, and wherein said frusto-conical base is threadably attached to said bottom.

6. The dispenser of claim 2, wherein said dispensing valve and said bottom are threadably attached.

7. The dispenser of claim 1, wherein said elongated container is blow molded.

8. The dispenser of claim 7, wherein said frusto-conical base is injection molded.

9. A liquid dispenser comprising:

a hollow, elongated container for the liquid, said container having a deformable hand-grip formed by a frusto-conical lower portion with a bottom wall at the larger diameter thereof and a waist at the upper end of said lower portion, said bottom wall having an opening therein for discharging liquid from said container, said frusto-conical lower portion and waist being ergonomically proportioned to permit gripping and compression by a human hand to cause ejection of liquid through said opening; and a frusto-conical base secured to said lower portion and forming a continuation of the frusto-conical shape of said lower portion, said base having a lower rim lying in a plane transverse to said elongated container for supporting same in an upright condition when said base is positioned on a substantially planar surface.

10. The dispenser of claim 9, wherein said container includes a bulbous upper portion adjacent to said waist, where said bulbous upper portion is of a size to prevent downward slippage of said dispenser when gripped.

11. The dispenser of claim 9, wherein said opening includes a valve having a normally closed configuration and an open configuration actuated by said compression.

12. The dispenser of claim 9, wherein said liquid is a soap.

13. The dispenser of claim 12, wherein said soap is a dish soap.

14. The dispenser of claim 9, wherein said frusto-conical base has a longitudinal passage therethrough adjacent to said opening.

15. The dispenser of claim 14, wherein said bottom wall adjacent to said opening is threaded, and wherein said longitudinal passage has threads adapted for mating with said threads of said opening.

* * * * *